US009130319B2

(12) United States Patent
Shimizu

(10) Patent No.: US 9,130,319 B2
(45) Date of Patent: Sep. 8, 2015

(54) CONNECTOR WITH SPRING CONTROLLED ELECTRODE AND SEALING

(75) Inventor: Shigejiro Shimizu, Ina (JP)

(73) Assignees: Shigejiro Shimizu (JP); Miraikogyo Co., Ltd. (JP); KS Consultant Kabushiki Kaisya (JP)

( * ) Notice: Subject to any disclaimer, the term of this patent is extended or adjusted under 35 U.S.C. 154(b) by 9 days.

(21) Appl. No.: 14/342,877

(22) PCT Filed: Sep. 6, 2012

(86) PCT No.: PCT/JP2012/072750
§ 371 (c)(1),
(2), (4) Date: Mar. 5, 2014

(87) PCT Pub. No.: WO2013/035789
PCT Pub. Date: Mar. 14, 2013

(65) Prior Publication Data

US 2014/0220801 A1 Aug. 7, 2014

(30) Foreign Application Priority Data

Sep. 7, 2011 (JP) ..... 2011-195516

(51) Int. Cl.

| | |
|---|---|
| ***H01R 13/44*** | (2006.01) |
| ***H01R 13/703*** | (2006.01) |
| ***H01R 4/48*** | (2006.01) |
| ***H01R 13/08*** | (2006.01) |

(Continued)

(52) U.S. Cl.
CPC ..... *H01R 13/7036* (2013.01); *H01R 4/4863* (2013.01); *H01R 13/08* (2013.01); *H01R 13/2421* (2013.01); *H01R 13/44* (2013.01); *H01R 13/52* (2013.01); *H01R 13/521* (2013.01); *H01R 13/641* (2013.01); *H01R 13/70* (2013.01)

(58) Field of Classification Search
CPC ..... H01R 13/52
USPC ..... 439/131, 587, 271–275
See application file for complete search history.

(56) References Cited

U.S. PATENT DOCUMENTS

| | | | |
|---|---|---|---|
| 3,805,216 | A | 4/1974 | Gaspar et al. |
| 5,358,418 | A | 10/1994 | Carmichael |

(Continued)

FOREIGN PATENT DOCUMENTS

| | | |
|---|---|---|
| FR | 2873237 | 1/2006 |
| JP | 5-74521 A | 3/1993 |

(Continued)

OTHER PUBLICATIONS

Supplementary European Search Report dated Feb. 19, 2015; EP Application No. 12829821.3.

*Primary Examiner* — Chandrika Prasad
(74) *Attorney, Agent, or Firm* — Quarles & Brady LLP; Gavin J. Milczarek-Desai

(57) ABSTRACT

A male connector and/or a female connector portion having a sealed chamber are utilized, and connection and separation of a first electrode and a facing second electrode are performed inside the sealed chamber. That is, the female connector portion is provided with: a casing; seal sections for sealing off the interior of the casing; first and second electrodes provided inside the casing; and an electrode connection control section that separates the first and second electrodes from each other in a state in which the female connector portion is not fitted to the male connector portion, and connects the electrodes together in a fitted state.

7 Claims, 7 Drawing Sheets

(51) Int. Cl.

| | |
|---|---|
| ***H01R 13/24*** | (2006.01) |
| ***H01R 13/52*** | (2006.01) |
| ***H01R 13/641*** | (2006.01) |
| ***H01R 13/70*** | (2006.01) |

(56) References Cited

U.S. PATENT DOCUMENTS

| | | | | |
|---|---|---|---|---|
| 6,053,777 | A * | 4/2000 | Boyle | 439/700 |
| 6,431,912 | B1 * | 8/2002 | Mori | 439/587 |
| 6,685,492 | B2 * | 2/2004 | Winter et al. | 439/219 |
| 6,743,043 | B2 * | 6/2004 | Yamada | 439/482 |
| 7,102,369 | B2 * | 9/2006 | Jung | 324/754.14 |
| 7,476,132 | B2 * | 1/2009 | Xu | 439/700 |
| 7,544,102 | B2 * | 6/2009 | Oda | 439/700 |
| 7,545,159 | B2 * | 6/2009 | Winter | 324/755.05 |
| 7,841,866 | B2 * | 11/2010 | Hsu et al. | 439/66 |
| 8,998,652 | B2 * | 4/2015 | Martineau | 439/700 |
| 2002/0115337 | A1 * | 8/2002 | Yamada | 439/482 |
| 2010/0221940 | A1 | 9/2010 | Hoyack et al. | |

FOREIGN PATENT DOCUMENTS

| | | | |
|---|---|---|---|
| JP | 7-240251 | A | 9/1995 |
| JP | 2001-143810 | A | 5/2001 |
| JP | 3689879 | B2 | 8/2005 |

* cited by examiner

CONNECTOR WITH SPRING CONTROLLED ELECTRODE AND SEALING

TECHNICAL FIELD

The present invention relates to a current-carrying connector that can stand up to waterproof, pressure-proof and explosion-proof usage.

BACKGROUND ART

A current-carrying connector configured such that the electrodes are not brought into contact with water by being protected with waterproof seals has been disclosed as a prior art (Patent literature 1). However, this technique is not intended for pressure-proof usage, and the electrodes are in an opened state. Accordingly, when one piece of the connector is mated with the other piece in a conductive liquid, if the conductive liquid is adhered to the circumference of the connector, the connector may cause an electrical leakage. When one piece of the connector is mated with the other piece in a flammable gas, the electrodes are in contact with the flammable gas. In such a case, if sparks are generated due to electric discharge, an ignition may occur.

Refer to Patent literature 2 as a document that describes a technique related to the invention to be disclosed in this specification.

CITATION LIST

Patent Literature

Patent literature 1: JP 5-74521 A
Patent literature 2: JP 3689879 B1

SUMMARY OF INVENTION

Technical Problem

When a male connector part and a female connector part, which configure a current-carrying connector, are mated with each other or the mating is released, if voltage is applied to a current-carrying cable in the connector, there are cases where an electrical leakage occurs in a conductive liquid or sparks are generated in a flammable gas due to electric discharge, causing an ignition. However, if current-carrying electrodes are mated with each other or the mating is released in an enclosed room that is completely isolated from a conductive liquid or a flammable gas, an electrical leakage can be prevented, and a risk that sparks generated due to electric discharge cause an ignition can also be prevented. This can equip the connector with an explosion-proof ability. Furthermore, by equipping the enclosed room with a pressure-proof ability, the connector can be made a pressure-proof connector.

Solution to Problem

The inventor accordingly uses a male connector part and/or a female connector part that have or has a pressure-proof enclosed room, and connects or separates current-carrying electrodes opposing each other in the enclosed room. It is preferable for the enclosed room to be filled with a non-flammable gas. Since the current-carrying electrodes are connected to or disconnected from each other within this enclosed room in feeding current therethrough, it is possible to provide a water-proof current-carrying connector equipped with a pressure-proof ability, which can avoid an electrical leakage, and to provide an explosion-proof current-carrying connector that can avoid an ignition.

A first aspect of this invention is specified as follows.

Specifically, a current-carrying connector is configured by mating a first connector part with a second connector part, and the first connector part includes: a casing; a sealing part sealing an interior of the casing; first and second electrodes disposed within the casing; and an electrode connection controller separating the first electrode from the second electrode in a state where the first connector part is not mated with the second connector part, and connecting the first electrode to the second electrode in a state where the first connector part is mated with the second connector part.

According to the current-carrying connector specified in this manner, the first and second electrodes are connected to or separated from each other, namely, the turn-on or turn-off is conducted within the casing in which the seal is maintained, in response to the mating or separation of the first and second connector parts. Accordingly, even when the first and second connector parts in the connector are mated with or separated from each other in a severe environment (flammable or conductive atmosphere, etc.), an electrical leakage to the severe environment is prevented, because both the electrodes are isolated from this severe environment.

Moreover, when codes are connected by this current-carrying connector in a severe environment, if an accidental force is applied to the codes, this connector is disconnected preferentially. This can prevent the codes themselves from being damaged, and avoid an electrical leakage from the codes.

A second aspect of this invention is specified as follows.

Specifically, in the current-carrying connector specified by the first aspect, the first electrode is exposed from the first connector part and a third electrode is exposed from the second connector part, in a state where the first connector part is not mated with the second connector part, and in a mating-demating transition of the first connector part and the second connector part, the electrode connection controller maintains connection between the first and third electrodes within the casing being sealed, and in the meantime, turns on or off current flow therebetween by connecting the first electrode to the second electrode or separating the first electrode from the second electrode within the casing.

According to the current-carrying connector in the second aspect specified in this manner, the first and third electrodes exposed to the outside world are connected to each other within the sealed casing in advance in a state where the first and third electrodes are isolated from the outside world and electrically independent. Followed by, when the first connector part is mated with the second connector part, the first and second electrodes are then connected to each other so that current flows between the first and third electrodes. On the other hand, when the first connector part is demated from the second connector part, the first and second electrodes are then isolated from each other so that current flow between the first and third electrodes is interrupted.

As described above, before current flows or is interrupted between a first electrode 20 and a third electrode 48 that are exposed from the first and second connector parts, respectively, to the outside world in the state where the first connector part is not mated with the second connector part, both the first electrode 20 and the third electrode 48 are isolated from the outside world. This can prevent an electrical leakage to the outside world reliably.

A fourth aspect of this invention is specified as follows. Specifically, in the current-carrying connector specified by the second aspect, the sealing part in the first connector part includes a movable sealing part opposing the second connector part, and a fixed sealing part on an opposite side of the movable sealing part, the movable sealing part is movable in an axial direction of the casing while maintaining the seal, the first electrode is attached to the movable sealing part, the fixed sealing part is fixed to the casing, and the second electrode is attached to the fixed sealing part, a biasing member is disposed between the movable sealing part and the fixed sealing part as the electrode connection controller, and can bias both of the movable sealing part and the fixed sealing part along a direction in which they are separated from each other, and the first electrode penetrates the movable sealing part, and is electrically connected to the second connector part through the exposed part of the first electrode.

According to the current-carrying connector specified by the fourth aspect which is specified in this manner, when the first connector part is not mated with the second connector part, no voltage is applied to the exposed part of the first electrode which penetrates the movable sealing part and is exposed therefrom, because the first electrode is separated from the second electrode in the first connector part. Therefore, even if the first electrode is partially exposed, no electrical leakage caused due to this would occur.

When the second connector part is mated with the first connector part, the movable sealing part that opposes the second connector part is pressed by this, and is moved to the interior of the casing deeply. Then, the movable sealing part approaches the fixed sealing part, and the first and second electrodes attached to them, respectively, are connected to each other. As a result, the first electrode enters a current carrying state, and the first electrode is electrically connected to the second connector part through its exposed part.

In this case, the biasing member such as a compressed coil spring is disposed between the fixed and movable sealing parts as the electrode connection controller, and biases the fixed and movable sealing parts along the direction in which they are separated from each other. This maintains the separation between the movable and fixed sealing parts in a state where the first connector part is not mated with the second connector part. As a result, the state where no current flows in the exposed part of the first electrode is maintained reliably. Furthermore, when the first connector part that has been mated with the second connector part becomes separated therefrom, the movable sealing part becomes separated from the fixed sealing part so that the first electrode becomes separated from the second electrode.

Since the movable sealing part is movable with respect to the casing in its axial direction while maintaining the seal therein, it is possible to prevent an electrical leakage to an outside environment reliably which would occur in response to the contact or separation (i.e., turn-on or turn-off) between the first and second electrodes.

DESCRIPTION OF EMBODIMENT

Hereinafter, some embodiments of this invention will be described.

Figure 1:
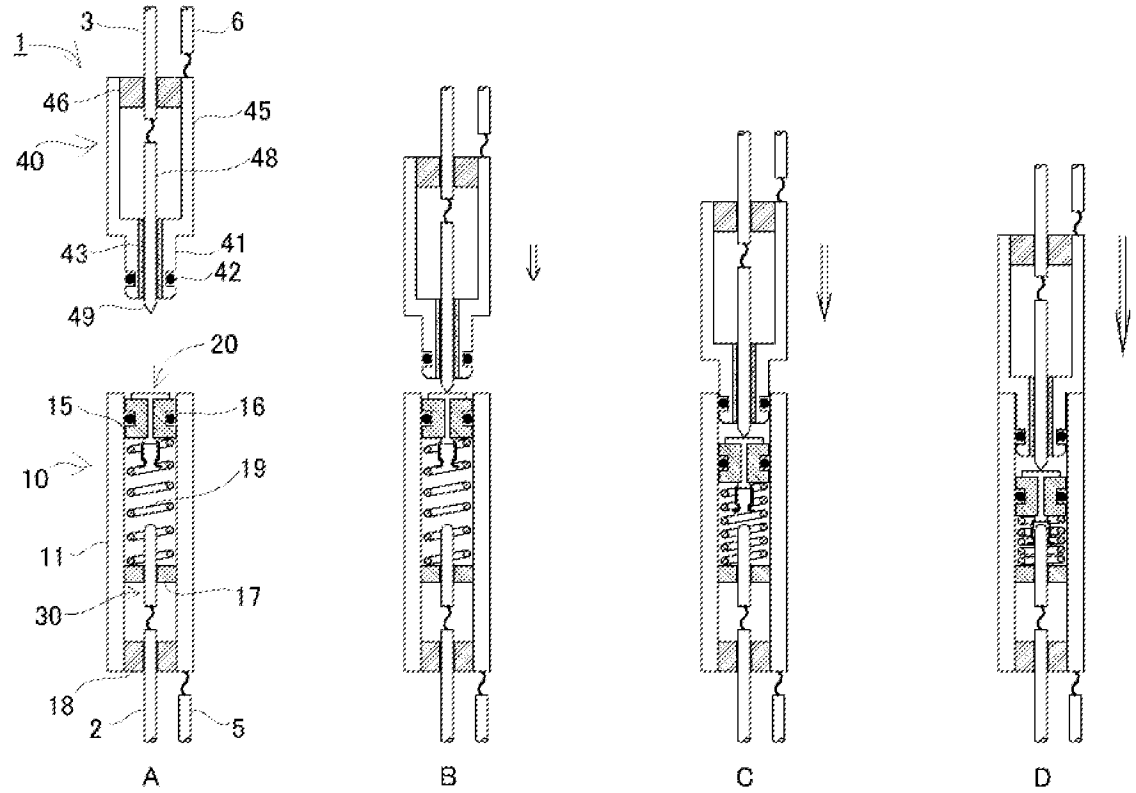
FIG. 1 is a cross-sectional view showing a configuration of a current-carrying connector in an embodiment of this invention.

FIG. 1 is a cross-sectional view showing a structure of a current-carrying connector 1 in an embodiment of this invention.

The connector 1 includes a female connector part 10 and a male connector part 40 as first and second connector parts, respectively, and the female connector part 10 is connected to a first current-carrying cable 2 and a first outer electrode (ground 5). The second connector part 40 is connected to a second current-carrying cable 3 and a second outer electrode (ground 6). The current-carrying cables 2 and 3 can supply electric power to a component to which the connector 1 is connected and send/receive electronic signals to or from this component.

The female connector part 10 has a cylindrical casing 11. This casing 11 is made of a metal material such as steel.

A first movable sealing part 15 is disposed on the inner circumference of the upper end (a side opposing the male connector part 40) of the casing 11, so as to be slidable in an axial direction of the casing 11. An O-ring 16 is put on the outer circumferential surface of this first movable sealing part 15, ensuring the seal between the outer circumferential surface of the first movable sealing part 15 and the inner circumferential surface of the casing 11.

A first fixed sealing part 17 fits into the casing 11, which ensures the seal between the first fixed sealing part 17 and the casing 11. A space enclosed with the casing 11, the first movable sealing part 15 and the first fixed sealing part 17 are shut out from the outside environment.

The reference numeral 18 in the drawing denotes a cap inserted into the other end of the casing 11, and the current-carrying cable 2 can be inserted into and pass through the cap. It is preferable for this cap 18 to also ensure the seal with the inner circumference of the casing 11 and the current-carrying cable 2.

A compressed coil spring 19 is disposed between the first movable sealing part 15 and the first fixed sealing part 17. This compressed coil spring 19 positions the first movable sealing part 15 at the end of the casing 11 when being in an unloaded state, as shown in FIG. 1A.

Instead of the compressed coil spring 19, a blade spring or some other spring-elastic material may be disposed as a biasing member.

This biasing member serves as an electrode connection controller that sets the first movable sealing part 15 away from the first fixed sealing part 17 (thereby disconnecting the first electrode 20 from the second electrode 30, both of which will be described below) in the state where the male connector part 40 is not mated with the female connector part 10. In addition, the electrode connection controller sets the first movable sealing part 15 close to the first fixed sealing part 17 (thereby connecting the first electrode 20 to the second electrode 30) in the state where the male connector part 40 is mated with the female connector part 10.

In this case, it is only necessary for the electrode connection controller to move the first electrode 20 within the casing 11 of the female connector part 10 in its axial direction, in conjunction with the male connector part 40.

The first electrode 20 includes an exposed part 21, a cap part 23 and a connection part 25.

The exposed part 21 is a plate-shaped member, and has a surface made of a soft conductive material (a metal, a conductive resin, etc.). When the end (made of a hard material) 49 of a third electrode 48 in the male connector part 40 is pressed against this surface, the end 49 is embedded in this surface, and the end 49 is thus brought into contact with the material of the exposed part 21 in a 3D manner. Therefore, even if the surface of the exposed part 21 is covered with foreign matters (dust, etc.), the connection is ensured between the electrode in the male connector part 40 and the exposed part 31, or the first electrode 20.

Figure 2:
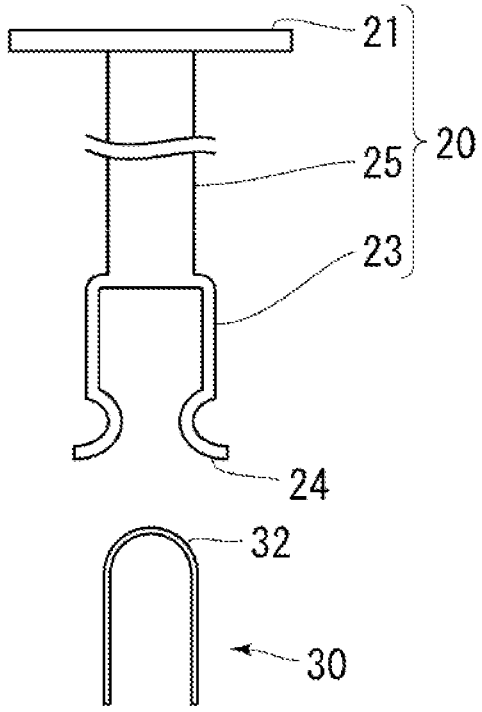
FIG. 2 is a partially enlarged view showing a connection mode between a first electrode and a second electrode.

The cap part 23 is disposed in the interior of the casing 11, and opposes an end 32 of the second electrode 30. As shown in detail in FIG. 2, the cap part 23 has a cylindrical shape with a bottom, and is formed such that its inner diameter is larger than the diameter of the end 32 of the second electrode 30. Its opening periphery 24 is bent inwardly, and the inner diameter of this curved part is smaller than the outer diameter of the end 32 of the second electrode 30.

Therefore, when the end 32 of the second electrode 30 is inserted into the cap part 23, the opening periphery 24 is widened by being elastically deformed in which case the electrical connection is ensured between the second electrode 30 and the cap part 23.

The cap part 23 is connected to the exposed part 21 through the connection part 25. The connection part 25 is attached to and fixed to the first movable sealing part 15 at its center. The seal between the connection part 25 and the first movable sealing part 15 is maintained.

The second electrode 30 is a rod-shaped member, and penetrates the first fixed sealing part 17 at its center while maintaining the seal of the first fixed sealing part 17. The end 32 is formed in a hemispherical shape, and is inserted into the cap part 23 smoothly.

Both the cap part 23 of the first electrode 20 and the end 32 of the second electrode 30 are positioned at the axial center of the casing 11, avoiding the interference with the compressed coil spring 19.

The male connector part 40 as the second connector part includes a small-diameter part 41 and a large-diameter part 45.

The small-diameter part 41 has an outer diameter that is the same as the inner diameter of the casing 11 in the female connector part 10, and then an O-ring 42, made of an insulating synthetic rubber, that is attached to the small-diameter part 41 ensures the seal therebetween.

A second fixed sealing part 43 made of an insulating synthetic rubber is disposed on the inner circumference of the small-diameter part 41.

By employing the configuration above, a space created by the small-diameter part 41, the casing 11 and the first movable sealing part 15 is isolated from the outside world in an airtight and liquid tight manner and the seal therein is ensured when the small-diameter part 41 is inserted into the female connector part 10.

The large-diameter part 45 has the same outer diameter as in the female connector part 10, and when the small-diameter part 41 is fully inserted into the female connector part 10, the large-diameter part 45 and the female connector part 10 form a continuous body. In other words, both the outer circumferential surfaces become flush with each other. A third fixed sealing part 46 is inserted into the opening of the large-diameter part 45 while ensuring the seal therein.

The third electrode 48 in the male connector part 40 is made of a rod-shaped metal material, and its end 49 is formed in a needle shape as an electrode opposing the female connector part 10. The material of at least the end 49 is harder than that of the surface of the exposed part 21 in the first electrode 20. This third electrode 48 is attached to the second fixed sealing part 43 at its center while ensuring the seal therein.

The second current-carrying cable 3 is attached to the third fixed sealing part 46 at its center while ensuring the seal therein.

An operation of the connector 1 configured above will be described on the basis of FIG. 1.

In this embodiment, it is assumed that the current-carrying cable 2 is connected to a power source but no electric power is supplied to the current-carrying cable 3.

The female connector part 10 and the male connector part 40 that are separated from each other are shown in FIG. 1A. When the connector parts 10 and 40 are coupled to each other, the end 49 of the third electrode 48 is first abutted on the exposed part 21 of the first electrode 20 (FIG. 1B). In this case, the end 49 is somewhat embedded in the exposed part 21, because the surface of the exposed part 21 is made of a soft conductive material. However, the first electrode 20 is separated from the second electrode 30 in this state, and therefore the first electrode 20 is electrically independent. Thus, no problems such as an electrical leakage would arise between the first electrode 20 and the third electrode 48.

As the small-diameter part 41 in the male connector part 40 is inserted into the female connector part 10 more deeply in the state of FIG. 1B, (FIG. 1C: mating-demating transition state of the connector parts), the first movable sealing part 15 is pressed and moved within the casing 11 more deeply along its axial direction by the force from the male connector part 40. In this case, a force for inserting the male connector part 40, which opposes the repelling force of the compressed coil spring 19, gradually increases, because the compressed coil spring 19 is compressed. As a result, the end 49 of the third electrode 48 is further embedded in the exposed part 21 of the first electrode 20, so that the connection is ensured between the third electrode 48 and the first electrode 20.

In the state shown in FIG. 1C, the first electrode 20 and the third electrode 48 are enclosed with the casing 11, the movable sealing part 15 and the small-diameter part 41, so that they are isolated from the outside world. In other words, they are connected to each other within the casing 11 in which the seal is ensured. In this case, since the first electrode 20 is separated from the second electrode 30, the first electrode 20 assumes an electrically floating state (independent or insulating state).

As described above, the first electrode 20 and the third electrode 48 are temporarily maintained in the state where they are separated from the outside world and electrically independent. Then, as shown in FIG. 1(D), when the male connector part 40 is inserted into the female connector part 10 until the final stage, the end of the second electrode 30 is attached to the cap part 23 of the first electrode 20, so that current flows between the first electrode 20 and the second electrode 30.

As a result, the current also flows between the first electrode 20 and the third electrode 48 in which case the first current-carrying cable 2 and the second current-carrying cable 3 enter a current-carrying state.

As for the description above, when the female connector part 10 and the male connector part 40 are individually isolated, before current flows between the first electrode 20 and third electrode 48 exposed to the outside world, the first electrode 20 and the third electrode 48 are temporarily isolated from the outside world within the casing 11 at the stage shown in FIG. 1(C). It is thus possible to reliably prevent an electrical leakage to the outside world.

In terms of the prevention of an electrical leakage to the outside world, if the casing 11 in the female connector part 10, the small-diameter part 41 and the large-diameter part 45 in the male connector part 40, and the various sealing parts 15, 17, 18, 42 and 43 are each made of an insulating material, an electrical leakage to the outside world can be prevented more reliably, and the connector 1 is accordingly usable, for example, in the seawater environment and the like.

An insulating organic material such as a synthetic rubber can be used for the various sealing parts, and the casing 11, the small-diameter part 41 and the large-diameter part 45 each can be made of an insulating synthetic resin, a ceramic or the like.

On the other hand, when the male connector part 40 is separated from the female connector part 10 in the state of FIG. 1D, the compressed coil spring 19 acts to separate the first electrode 20 from the second electrode 30 within the casing 11 in which the seal is maintained while maintaining the connection between the first electrode 20 and the third electrode 48, as shown in FIG. 1C.

As a result, the first electrode 20 is separated from the electrical pathway, namely, enters an electrically independent state, and then the current flow between the first electrode 20 and the third electrode 48 is interrupted within the casing 11 in which the sealing is ensured while the first electrode 20 and the third electrode 48 is isolated from the outside world. Thus, even when the current flow between the first electrode 20 and the third electrode 48 is interrupted, no electric discharge would occur.

In the state where the male connector part 40 is completely separated from the female connector part 10 (FIG. 1(A)), the first movable sealing part 15 in the female connector part 10 is positioned at the end of the casing 11 because of the action of the compressed coil spring 19.

Figure 3:
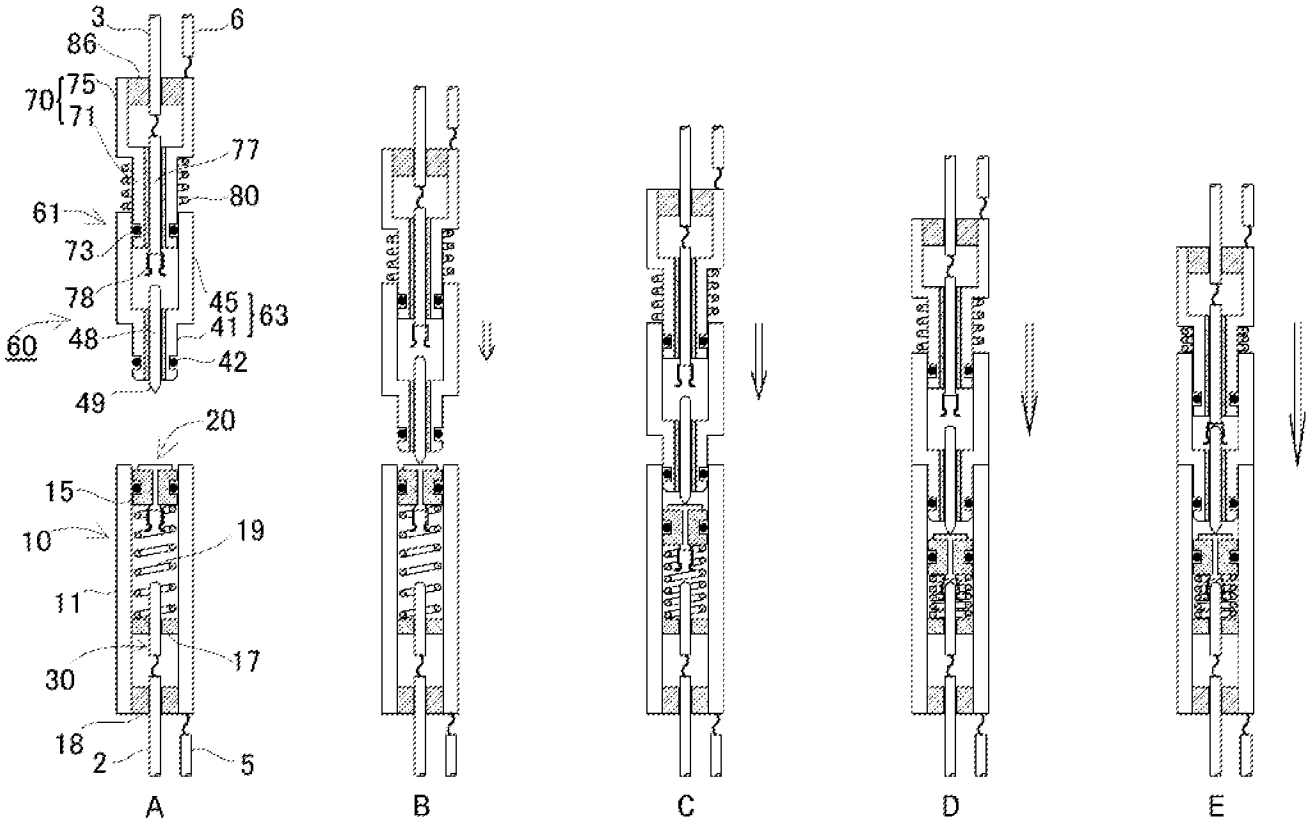
FIG. 3 is a cross-sectional view showing a configuration of a current-carrying connector in another embodiment of this invention.

FIG. 3 shows a connector 60 in another embodiment. It should be noted that the same characters are assigned to elements in FIG. 3 which are the same as those in FIG. 1, and descriptions thereof will be omitted. In this example, it is assumed that current-carrying cables 2 and 3 are connectable to power sources.

This connector 60 includes a female connector part 10 and a male connector part 61.

The female connector part 10 is the same as that in FIG. 1.

The male connector part 61 includes a second casing 63 and a third casing 70. The second casing 63 is a configuration in which the third fixed sealing part 46 is removed from the male connector part 30 in FIG. 1.

The third casing 70 also includes a small-diameter part 71 and a large-diameter part 75, and the small-diameter part 71 is inserted into the large-diameter part 45 of the second casing 63 while maintaining the seal therein. A fourth electrode 77 penetrates the small-diameter part 71 while maintaining the seal therein, and its end is equipped with a second cap part 78. This second cap part 78 also has a cylindrical shape with a bottom, similar to a first cap part 23, and the opening periphery is folded inwardly so as to enable the end of the third electrode 48 to be inserted and to ensure the contact of the third electrode 48 with the second cap part 78.

A second compressed coil spring 80 is attached to the outer circumference of the small-diameter part 71. This second compressed coil spring 80 is disposed between an end of the second casing 63 and a step between the small-diameter part 71 and the large-diameter part 75 in the third casing 70, and biases them along a direction in which they are isolated from each other.

This second compressed coil spring 80 has a larger spring constant than a first compressed coil spring 19, and it is preferable for the second compressed coil spring 80 to start being compressed after the compression of the first compressed coil spring 19 is completed, as shown in D and E of FIG. 3.

Instead of the second compressed coil spring 80, a member that has a blade spring or some other spring-elastic material may be disposed between the second casing 63 and the third casing 70.

An O-ring 73 is attached to the outer circumference of an end of the small-diameter part 71 in the third casing 70, and ensures the seal between the small-diameter part 71 and the large-diameter part 45 of the second casing 63.

The reference numeral 86 denotes a fourth fixed sealing part, and seals an opening in the large-diameter part 71 of the third casing 70. A current-carrying cable 3 penetrates this third fixed sealing part 86 at its center.

Next, an operation of the connector 60 shown in FIG. 3 will be described.

In the state of FIG. 3A, both a first electrode 20 and a second electrode 30 are separated from each other, and both a third electrode 48 and the fourth electrode 77 are separated from each other. The second compressed coil spring 80 sets the small-diameter part 71 in the third casing 70 to a state where it is inserted into the large-diameter part 45 in the second casing 63, when being in an unloaded state.

When the male connector part 61 is further pressed against the female connector part 10 in the state of being abutted on it (FIG. 3B), the first compressed coil spring 19 having a relatively small spring constant is compressed, and a first movable sealing part 15 is moved in the casing 11 deeply (FIG. 3C). When the male connector part 61 is further pressed, the first electrode 20 is connected to the second electrode 30 within the casing 11 in which the seal is maintained (FIG. 3D).

In the state of FIG. 3C, namely, in the mating-demating transition state of the female connector part 10 and the male connector part 60, the first electrode 20 is connected to the third electrode 48 within the sealed casing 11 while being temporarily isolated from the outside world. In this case, since the first electrode 20 is separated from the second electrode 30, the first electrode 20 is in a floating state, or in an electrically independent state. Likewise, since the third electrode 48 is separated from the fourth electrode 77 within the sealed second casing 63, the third electrode 48 is also in an electrically floating state, or in an electrically independent state.

In the state of FIG. 3D, then, the first electrode 20 is connected to the second electrode 30, and in the state of FIG. 3E, the third electrode 48 is connected to the fourth electrode 77. As a result, current flows between the first electrode 20 and the third electrode 48 (turn-on). When the current flows, the first electrode 20 and the third electrode 48 within the sealed casing 11 are isolated from the outside world. Therefore, no electrical leakage from both the electrodes would occur.

Even in this example, it is preferable that the individual constituent components (the casing 11 and the sealing part 15, 17 and 18) of the female connector part 10 and the individual constituent components (the casings 63 and 70 and the sealing members 42 and 43) of the male connector part 61 have an insulating property.

When the male connector part 61 is isolated from the female connector part 10, first, the second compressed coil spring 80 having a large spring constant acts to release the contact of the third electrode 48 with the fourth electrode 77 (FIG. 3D). Then, the contact of the first electrode 20 with the second electrode 30 is released while the contact of the third electrode 48 with the first electrode 20 is maintained (FIG. 3C). Thus, after each of the first electrode 20 and the third electrode 48 enters an electrically independent state within the casing 11 in which the seal is ensured, the current flow between the first electrode 20 and the third electrode 48 is interrupted. Consequently, even when the current flow between both the electrodes is interrupted (off), none of electric discharge and the like would occur.

In each of the foregoing embodiments, an inactive gas such as a nitrogen gas, or a non-flammable gas, may fill in the respective spaces in which the first electrode 20 is in contact with the second electrode 30 and in which the third electrode 48 is in contact with the fourth electrode 77.

In order to improve the seal between each sealing part and each casing and between each sealing part and each electrode, second seal materials may be disposed. Alternatively, the seal may be improved with an adhesive.

The configuration of the connector exemplified in FIGS. 1 and 3 may be formed at both the ends of a long casing. In more detail, the female connector part 10 is applied to a structure of an end of the long casing, and the male connector part 40 or 61 is applied to a structure of the other end. This enables these current-carrying cables to be connected to each other easily, securely and reliably when the long casing is coupled.

The respective ends of the male connector part and the female connector part on the opposite sides of the ends facing each other may be each provided with a connection part (a screw or the like) for other members. In this case, the current-carrying cables 2 and 3 for piping pass through the other members.

This modification aspect is applicable to embodiments that will be described below.

Figure 4:
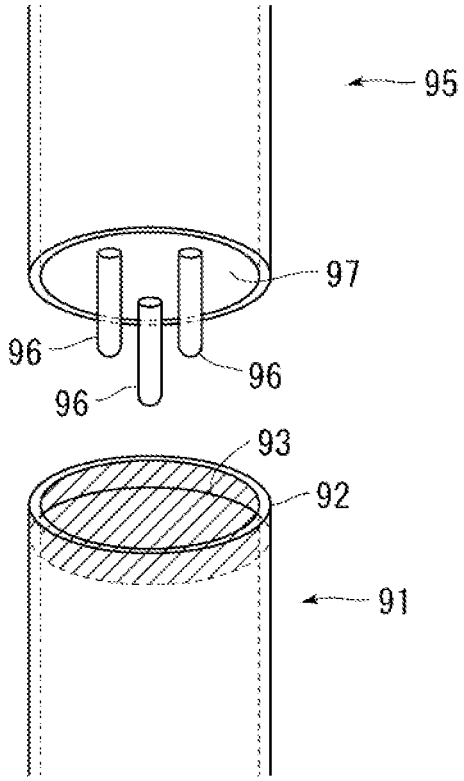
FIG. 4 is a partially enlarged view showing another connection mode between the first electrode and a third electrode.

FIG. 4 shows another connection mode between a first electrode 91 exposed from a female connector part and a third electrode 95 in a male connector part which corresponds to the first electrode 91.

The reference numeral 92 denotes an exposed part of the first electrode 91, and a surface layer 93 thereof is made of a soft conductive material.

In this example, the third electrode 95 includes a plurality of needle-shaped electrodes 96. The needle-shaped electrodes are distributed concentrically at fixed spacings while being centered on the center of an end surface 97 in the third electrode 95.

Using the plurality of needle-shaped electrodes 96 always stabilizes the electrical connection between them, because when the first electrode 91 is repeatedly coupled to or released from the third electrode 95, the needle-shaped electrodes 96 are embedded in a fresh portion of a layer surface 93 made of a soft conductive material by rotating at least one of the electrodes (i.e., connector parts).

By arranging the needle-shaped electrodes 96 concentrically, the durability of the needle-shaped electrodes 96 is improved, because a force is uniformly applied to the needle-shaped electrodes 96.

Alternatively, one or more needle-shaped electrodes may be provided on the first electrode 91 side, whereas a surface layer made of a soft conductive material may be provided on the third electrode 95 side. Moreover, each of them may be provided with needle-shaped electrodes and a soft surface layer.

Figure 5:
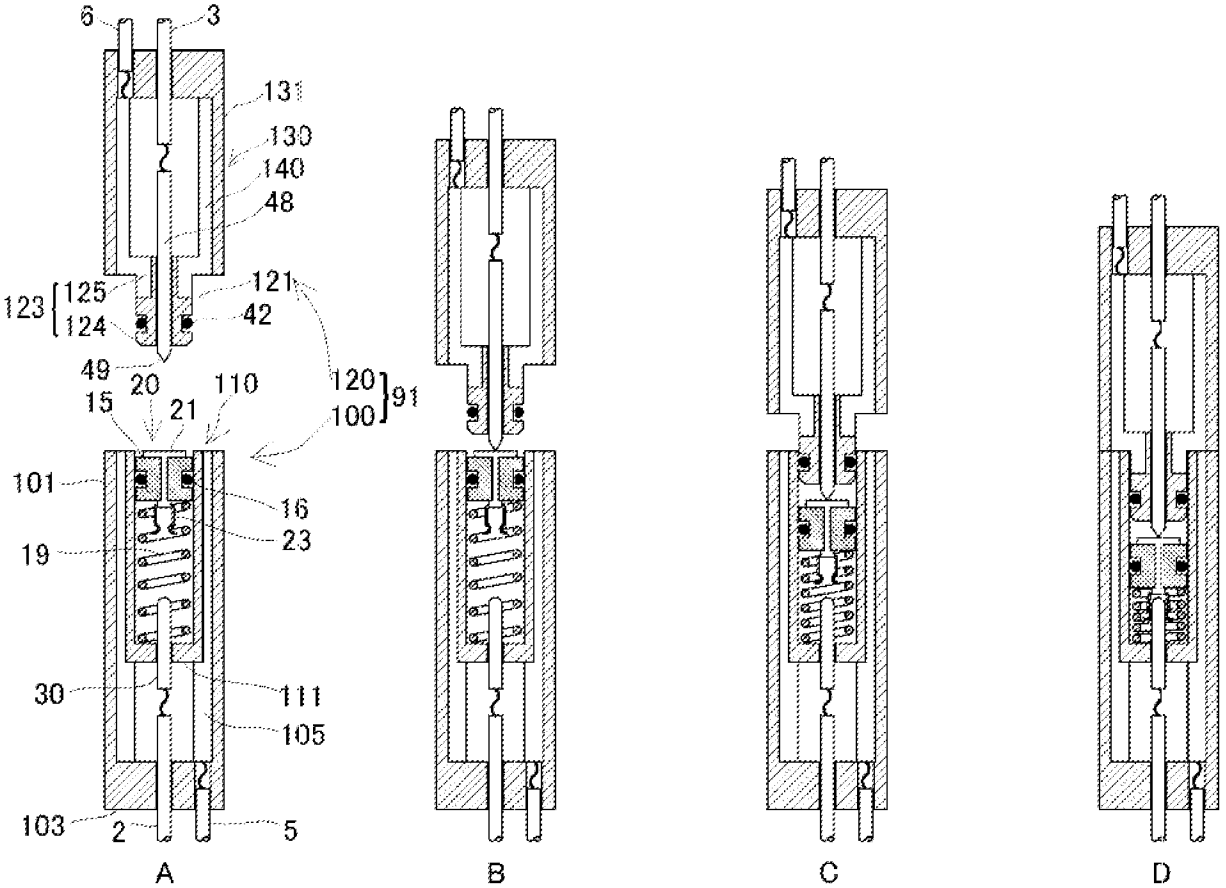
FIG. 5 is a schematic view showing a configuration of a current-carrying connector in another embodiment of this invention.

FIG. 5 shows a connector 91 in another embodiment. It should be noted that the same characters are assigned to elements that are the same as those in FIG. 1, and descriptions thereof will be omitted.

This connector 91 includes a female connector part 100 and a male connector part 120. The female connector part 100 includes a casing 101 that has a cylindrical shape with a bottom, a ground electrode 105, and an insulating capsule 110 that also has a cylindrical shape with a bottom.

Each of the casing 101 and the capsule 110 is made of an insulating synthetic resin or a ceramic material. In addition, it is preferable for this material to be able to stand up to an environment in which the connector 91 is used.

The ground electrode 105 is provided on the inner circumference of the casing 101, and also plays a role in fixing the capsule 110 to the opening of the casing 101. In this example, the casing 101, the ground electrode 105 and the capsule 110 are in contact with one another, and the seal is ensured between the outside and a space defined by a bottom wall 111 of the capsule 110 and a bottom wall 105 of the casing 101. A first movable sealing part 15, a compressed coil spring 19, a first electrode 20 and a second electrode 30 are provided in the capsule 110, and the second electrode 30 penetrates the bottom wall 111 of the capsule 110 while ensuring the seal therein.

The male connector part 120 includes a small-diameter part 121 and a large-diameter part 130. An end member 123 of the small-diameter part 121 is made of an insulating material, and a third electrode 48 penetrates the end member 123 at its center while ensuring the seal therein. The end member 123 includes a base 124 to be mated with the capsule 110, and a sleeve 125 that protects the third electrode 48.

The large-diameter part 130 is provided with an outer casing member 131, made of an insulating material, that has a cylindrical shape with a bottom. A cylindrical electrode 140 is attached to the inner circumference of the outer casing member 131. This cylindrical electrode 140 has a diameter that decreases at its one end, and the sleeve 125 of the end member 121 in the small-diameter part 120 fits into this end of the cylindrical electrode 140.

An operation of the connector 91 formed in this manner is shown in FIG. 5. When the first electrode 20 and the third electrode 48 exposed from the female connector part 100 and the male connector part 120, respectively, are brought into contact with each other or removed from each other, the first electrode 20 is in an electrically floating state. Therefore, no electrical leakage would occur from the space between them to the outside.

Furthermore, when a current flows or stops between the first electrode 20 and the third electrode 48, as shown in FIGS. 5C to D, the first electrode 20 has been connected to the third electrode 48 in advance, and the atmosphere at this connection point is sealed against the outside and insulated therefrom. It is thus possible to mate/demate the female connector part 100 to or from the male connector part 120 securely even in seawater or a flammable gas.

Figure 6:
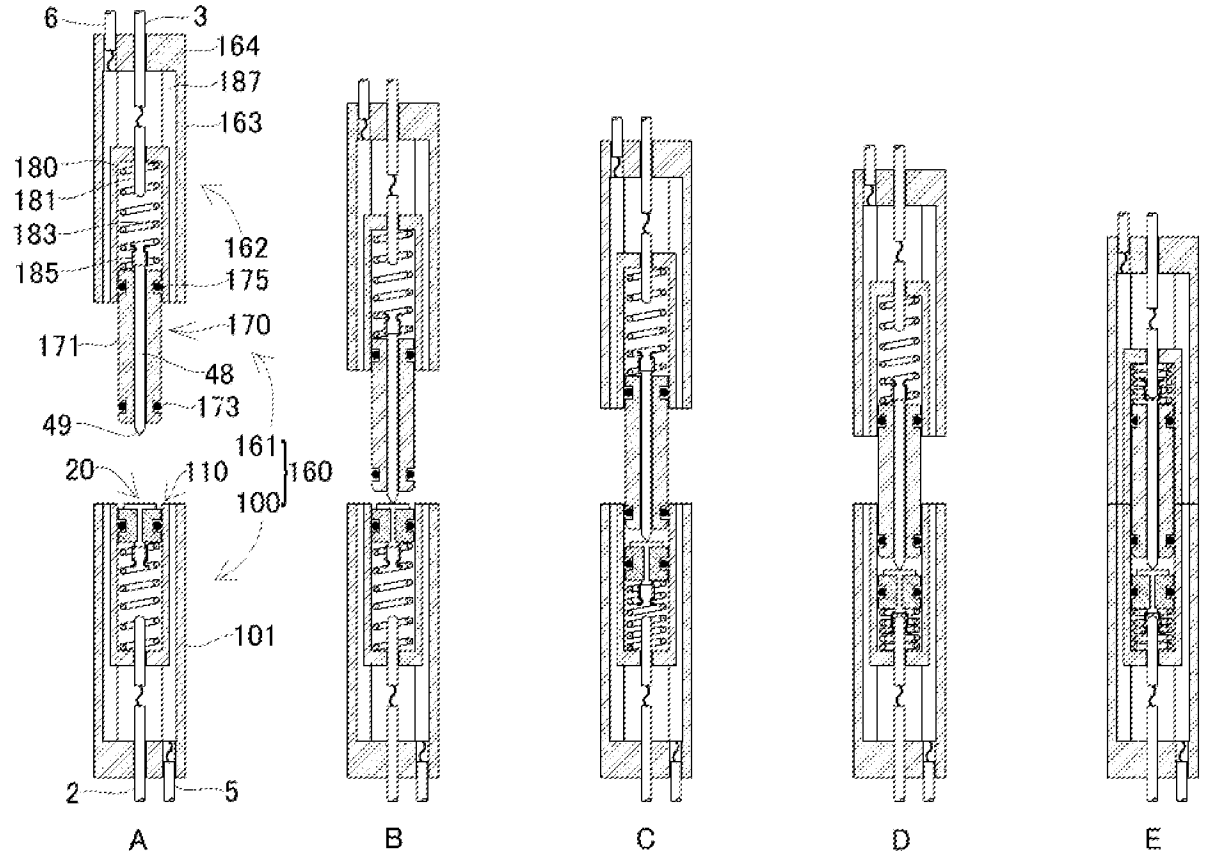
FIG. 6 is a schematic view showing a configuration of a current-carrying connector in another embodiment of this invention.

FIG. 6 shows a connector 160 in another embodiment. The same characters are assigned to elements in FIG. 6 which are the same as those in FIG. 5, and descriptions thereof will be omitted.

In the example of FIG. 6, a male connector part 161 includes a large-diameter part 162 and a small-diameter part 170. The large-diameter part 162 includes a casing 163, made of an insulating material, that has a cylindrical shape with a bottom, and a cylindrical electrode 187 disposed on the inner circumferential surface of the casing 163.

The small-diameter part 170 includes a base 171 and a capsule 180. The base 171 is made of an insulating material, and its outer diameter is substantially as large as the inner circumferential surface of a capsule 110 on the female connector part 100 side, and the seal therebetween are ensured by an O-ring 173. A third electrode 48 is inserted into and passes through the base 171 at its center. The third electrode 48 has a lower end 49 formed in a needle shape, and an upper end thereof is provided with a cap part 185. This cap part 185 has the same configuration as in a cap part 23 of a female connector part 100 or the second cap part 78 of the example in FIG. 3.

The capsule 180 is fixed to the opening of the casing 163 through the cylindrical electrode 187. The seal is ensured between the inner circumferential surface of the casing 163 and the cylindrical electrode 187 and between the cylindrical electrode 187 and the capsule 180.

The capsule 180 is a member, made of an insulating material, that has a cylindrical shape with a bottom, and the base 171 is inserted into its opening so as to be movable in the axial direction. An O-ring 175 is responsible for the seal between the base 171 and the inner circumferential surface of the capsule 180. A compressed coil spring 183 is disposed within the capsule 180, and biases the base 171 in an isolation direction. The reference numeral 181 denotes a fourth electrode, which penetrates the bottom of the capsule 180 while ensuring the seal therein.

In the male connector part 161, the interior of the capsule 181 is sealed against the outside by the base 171. Likewise, an inner space of the casing 163, which is partitioned by the capsule 180 and the bottom wall 164, is also sealed against the outside.

An operation of the connector 160 formed in this manner is shown in FIG. 6. When a first electrode 20 and the third electrode 48 exposed from the female connector part 100 and the male connector part 161, respectively, are brought into contact with each other or removed from each other, the first electrode 20 and the third electrode 48 are in an electrically floating state. Therefore, no electrical leakage would occur from the space therebetween to the outside.

Furthermore, when a current flows or stops between the first electrode 20 and the third electrode 48, as shown in FIGS. 6C to E, the first electrode 20 has been connected to the third electrode 48 in advance, and the atmosphere at this connection point is sealed against the outside and insulated therefrom. It is thus possible to mate/demate the female connector part 100 to or from the male connector part 161 securely even in seawater or a flammable gas.

Since the connector in the present invention can be structured concentrically, an axial target connector is made easily.

Another example of the present invention will be described with reference to FIG. 7.

Figure 7:
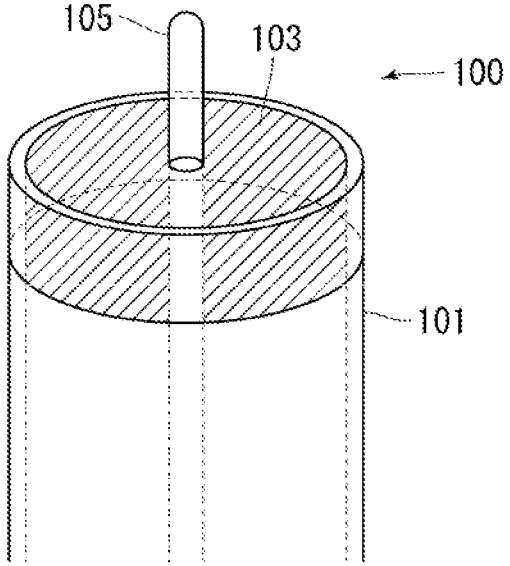
FIG. 7 is a schematic view showing a configuration of a current-carrying connector in another embodiment of this invention.

In FIG. 7, the reference numeral 100 denotes a male connector part. In this male connector part 100, a fixed sealing member 103 fits into an end of a casing 101. A core wire 105 made of a thin conductive pipe or a thin solid rod penetrates the fixed sealing member 103 at its center, and is connected to a wire.

On the other hand, it is only necessary for a female connector part to have a space that accommodates the core wire 105.

Employing the configuration above obtains a coaxial cable for communications.

By using a metal pipe as the outer jacket for the coaxial cable, the coaxial cable can be made robust enough to resist bending and endure a tensile strength. Furthermore, if the core wire is also made of a solid metal rod or pipe, the coaxial cable can be made more robust so that it can transmit data securely at sites of a civil engineering work and the like. Using a coaxial cable makes it possible to transmit a large number of signals at different frequencies in a multiplex manner while supplying electric power. In addition, data transmission using faint signals can be conducted with a small number of consumed electrodes.

As for a method of transmitting or receiving data in this example, refer to Patent literature 2 (JP 3689879 B1).

The present invention is not limited to the above embodiments of the invention and the above example at all. Various embodiments that are made without departing from the description in the claims and to the extent that a person skilled in the art could easily conceive of it are also included in the present invention.

In this invention, the atmosphere at each connection point between the electrodes is sealed against the external environment. O-rings and other sealing materials required for this sealing are selected as appropriate, depending on the external environment.

REFERENCE SIGN LIST

1, 60, 91, 160 connector
10, 100 female connector part
15 first movable sealing part
17 first fixed sealing part
19, 80 compressed coil spring
20 first electrode
21 exposed part
30 second electrode
32 end
40, 61, 120, 161 male connector part
41, 71, 121, 170 small-diameter part
45, 75, 130, 162 large-diameter part
63 second casing
70 third casing
77, 181 fourth electrode

The invention claimed is:

1. A current-carrying connector configured by mating a first connector part with a second connector part, the first connector part comprising: a casing; a sealing part sealing an interior of the casing; first and second electrodes disposed within the casing; and an electrode connection controller separating the first electrode from the second electrode in a state where the first connector part is not mated with the second connector part, and connecting the first electrode to the second electrode in a state where the first connector part is mated with the second connector part, wherein part of the first electrode is exposed from the first connector part and a third electrode is exposed from the second connector part, in a state where the first connector part is not mated with the second connector part, and wherein in a mating-demating transition of the first connector part and the second connector part, the electrode connection controller maintains connection between the part of the first electrode and the third electrode within the casing being sealed, and in the meantime, turns on or off current flow therebetween by connecting the first electrode to the second electrode or separating the first electrode from the second electrode within the casing being sealed.

2. The current-carrying connector according to claim 1 wherein electric power is applied to the second electrode.

3. The current-carrying connector according to claim 1 wherein the sealing part in the first connector part includes a movable sealing part opposing the second connector part, and a fixed sealing part on an opposite side of the movable sealing part, the movable sealing part is movable in an axial direction of the casing while maintaining the seal, the first electrode is attached to the movable sealing part, the fixed sealing part is fixed to the casing, and the second electrode is attached to the fixed sealing part, a biasing member is disposed between the movable sealing part and the fixed sealing part as the electrode connection controller, and can bias both of the movable sealing part and the fixed sealing part along a direction in which they are separated from each other, and the first electrode penetrates the movable sealing part, and is electrically connected to the third electrode of the second connector part through the exposed part of the first electrode.

4. The current-carrying connector according to claim 1 wherein the exposed part of the first electrode has a soft conductive material surface, and an opposing electrode in the third electrode of the second connector part which opposes the first connector part is formed in a needle shape to be able to be embedded in the exposed part.

5. The current-carrying connector according to claim 1 wherein the second connector part includes a second casing, a second sealing part sealing an interior of the second casing, third and fourth electrodes disposed within the second casing, and a second electrode connection controller separating the third electrode from the fourth electrode in a state where the first connector part is not mated with the second connector part and connecting the third electrode to the fourth electrode in a state where the first connector part is mated with the second connector part.

6. The current-carrying connector according to claim 5 wherein the first connector part is a female connector, and the second connector part is a male connector, the second connector part includes a second casing and a third casing, the second casing has a second small-diameter part and a second large-diameter part, and the third casing has a third small-diameter part and a third large-diameter part, the second small-diameter part of the second casing is inserted into the first casing while maintaining the seal, and the third small-diameter part of the third casing fits into the second large-diameter part of the second casing while maintaining a seal and is movable in its axial direction, the third electrode penetrates the second small-diameter part, and an exposed part thereof is formed in the needle shape, the fourth electrode penetrates the third small-diameter part, and is disposed to be connectable to the third electrode, a second compressed coil spring is disposed between the second casing and the third casing and biases both of the second casing and the third casing along a direction in which they are separated from each other, and the second compressed coil spring separates the third electrode from the fourth electrode in a state where the first connector part is not mated with the second connector part, and connects the third electrode to the fourth electrode in a state where the first connector part is mated with the second connector part, and in a mating-demating transition of the first connector part and the second connector part, current flow between the first electrode and the third electrode connected to each other within the casing being sealed is turned on or off by connecting the third electrode to the fourth electrode or separating the third electrode from the fourth electrode within the large-diameter part in the second casing being sealed.

7. The current-carrying connector according to claim 6 wherein a spring constant of the second compressed coil spring is larger than that of a first compressed coil spring as the biasing member, and when the second connector part is inserted into the first connector part, the first electrode is connected to the second electrode in the first connector part, and then the third electrode is connected to the fourth electrode in the second connector part.

* * * * *